US008502519B2

(12) United States Patent
Riedel

(10) Patent No.: US 8,502,519 B2
(45) Date of Patent: Aug. 6, 2013

(54) ARRANGEMENT AND APPROACH FOR PROVIDING A REFERENCE VOLTAGE

(75) Inventor: Friedbert Riedel, Zug (CH)

(73) Assignee: NXP B.V., Eindhoven (NL)

( * ) Notice: Subject to any disclaimer, the term of this patent is extended or adjusted under 35 U.S.C. 154(b) by 424 days.

(21) Appl. No.: 12/745,286

(22) PCT Filed: Nov. 27, 2008

(86) PCT No.: PCT/IB2008/054978

§ 371 (c)(1),
(2), (4) Date: Jun. 10, 2010

(87) PCT Pub. No.: WO2009/069093

PCT Pub. Date: Jun. 4, 2009

(65) Prior Publication Data

US 2010/0270997 A1 Oct. 28, 2010

Related U.S. Application Data

(60) Provisional application No. 60/991,485, filed on Nov. 30, 2007.

(51) Int. Cl.
*G05F 3/04* (2006.01)
*G05F 3/08* (2006.01)
*G05F 1/00* (2006.01)

(52) U.S. Cl.
USPC ..... 323/311; 323/271

(58) Field of Classification Search
USPC ..... 363/60; 323/311, 271
See application file for complete search history.

(56) References Cited

U.S. PATENT DOCUMENTS

| | | | | |
|---|---|---|---|---|
| 6,281,743 | B1 | 8/2001 | Doyle | |
| 2002/0121888 | A1 * | 9/2002 | Reithmaier et al. | 323/313 |
| 2005/0285666 | A1 | 12/2005 | Garlapati et al. | |
| 2006/0038608 | A1 | 2/2006 | Ozawa | |
| 2006/0043957 | A1 | 3/2006 | Carvalho | |
| 2006/0274557 | A1 * | 12/2006 | Ball et al. | 363/19 |
| 2008/0036530 | A1 | 2/2008 | Chang | |
| 2009/0021308 | A1 * | 1/2009 | Heilmann | 330/288 |
| 2009/0039845 | A1 | 2/2009 | Gerber et al. | |

FOREIGN PATENT DOCUMENTS

| | | | |
|---|---|---|---|
| DE | 10 2007 031528 | A1 | 1/2009 |
| EP | 0 454 243 | A1 | 10/1991 |
| EP | 0 899 643 | | 3/1999 |

(Continued)

OTHER PUBLICATIONS

Baker, R. J., et al "CMOS Circuit Design, Layout, and Simulation"; IEEE Press Series on Microelectronic Systems, cover, 3 unnumbered front pages, pp. 477-488 (1998).

(Continued)

*Primary Examiner* — Adolf Berhane
*Assistant Examiner* — Emily Pham

(57) ABSTRACT

A reference voltage that is consistent over various operational conditions and uses low power is provided. According to an example, an internal temperature-compensated voltage (e.g., vdd_int in 200) is generated from a power supply (e.g., vdd in 200), and a reference voltage (e.g., vref in 200) is generated from the internal voltage. The reference voltage is stored on a storage circuit (e.g., 430) that is coupled (charged) and refreshed under conditions, relative to circuit characteristics, that make low and ultra-low power operation possible.

20 Claims, 4 Drawing Sheets

| | WIDE POWER RANGE | | |
|---|---|---|---|
| vdd | 2V | 5.5V | PSRR(DC) |
| vref @ 27C | 1.24947V | 1.24920V | 82.25dB |
| vref @-40C | 1.24713V | 1.24707V | 95.3dB |
| vref @ 90C | 1.20478V | 1.20431V | 77.4dB |

FOREIGN PATENT DOCUMENTS

| | | | |
|---|---|---|---|
| EP | 1 231 528 | A2 | 8/2002 |
| GB | 2 308 684 | A | 7/1997 |
| WO | 03/061317 | A2 | 7/2003 |

OTHER PUBLICATIONS

Banba, Hironori, et al. "A CMOS Band-Gap Reference Circuit With Sub IV Operation," 1998 Symposium on VLSI Circuits Digest of Technical Papers, pp. 228-229 (1998).

Gromov, V. "Development of the Bandgap Voltage Reference Circuit, Featuring Dynamic-Threshold MOS Transistors (DTMOST's) in 0.13um CMOS Technology," Nikhef, Kruislaan 409, Amsterdam, NL, 2 pgs. (May 2004).

Yu, et al. "A High Precision CMOS Current-mode Band-gap Voltage Reference," Solid State and Integrated Circuit Technology, pp. 1736-1738 (Oct. 2006).

Tuite, Don "Floating Gate Technology Voltage References Go Down to 1.25 and 2.5V," Electronic Design, Intersil (Feb. 2007).

International Search Report and Written Opinion for Int'l. Patent Appln. No. PCT/IB2008/054978.

* cited by examiner

| | WIDE POWER RANGE | | | |
|---|---|---|---|---|
| vdd | 2V | 5.5V | PSRR(DC) |
| vref @ 27C | 1.24947V | 1.24920V | 82.25dB |
| vref @-40C | 1.24713V | 1.24707V | 95.3dB |
| vref @ 90C | 1.20478V | 1.20431V | 77.4dB |

ARRANGEMENT AND APPROACH FOR PROVIDING A REFERENCE VOLTAGE

The present invention relates generally to electronic applications, and more specifically, to circuits and methods for providing a reference voltage.

Many electronic devices operate using a reference voltage to power circuits under various conditions. In many of these devices, power conservation is at least desirable, if not very important to the operation of the device. For example, portable devices operating on battery power must conserve power to extend the operational life of the device. Unfortunately, achieving low power consumption has been difficult from standpoints of power demand and circuit functionality. In this regard, achieving such low power operation is important, yet has also been highly challenging.

Many low-power circuit designs employ a reference voltage (Vref) for various operational characteristics. Circuits used in these designs are often temperature and process dependent, and reference voltage levels vary in accordance with power supply noise, which can be expressed by the power supply rejection ratio (PSRR). The PSRR value depends upon the frequency of the supply noise and respective changes in power supply (changes in Vdd).

For very low frequency supply changes in Vdd, the DC value of PSRR (PSRR(DC)) exhibits a value that is often too small to be of use for many applications. For example, if Vdd is changing in the range of about 5% to 10%, which is characteristic of many circuits, the unregulated Vref change is on the order of some 10 mVolts, which is often tolerable. However, if Vdd changes at a greater range (e.g., in excess of 10%), the tolerance range of Vref is often not acceptable. For instance, where Vref fluctuates from 2V to 4V, using Vdd to provide a constant low voltage (2V) supply results in significant power loss when Vdd rises above about 2.2V up through 4V as this higher power is provided over a wide range of the 2V-4V operation yet goes unused.

These and other issues have presented challenges to the implementation of switchover circuits.

Various aspects of the present invention are directed to arrangements for and methods of generating a reference voltage, which is amenable to low-power operation, in a manner that addresses and overcomes the above-mentioned issues and other issues as directly and indirectly addressed in the detailed description that follows.

According to an example embodiment of the present invention, a system generates a low power reference voltage from a power supply that provides voltage that fluctuates over a range of voltage. The system includes a regulation circuit to generate an internal voltage from the power supply voltage, where the internal voltage corresponds to a low voltage in the range of voltages. A reference voltage circuit is coupled to the regulation circuit to receive the generated internal voltage, and generates a reference voltage from the internal voltage. A sample-and-hold storage circuit is coupled to the reference voltage circuit to receive the generated reference voltage, stores the reference voltage and provides the stored voltage as an output. A control circuit cyclically couples the power supply for generating the reference voltage, and cyclically couples the storage circuit for storing the reference voltage, with the nature of the coupling (i.e., the timing of coupling and decoupling) controlled as a function of circuit characteristics of the storage circuit and a circuit connecting the reference voltage to the storage circuit. These characteristics may include, for example, charge and leakage characteristics that relate to the ability to maintain the reference voltage in a stored condition over time.

According to another example embodiment of the present invention, a storage and control circuit arrangement provides a reference voltage from a power supply. The circuit arrangement includes a power supply switch to connect the power supply for generating the reference voltage, and a storage circuit to receive and store the generated reference voltage. A storage switch couples the storage circuit to the generated reference voltage. A control circuit controls the closing and opening of the power supply switch and the storage switch, to respectively cyclically couple the power supply and the storage circuit as a function of circuit characteristics of both the storage circuit and the storage switch. This control is effected for each cycle by closing the power supply switch for a first time period and, after the first time period, opening the power supply switch. Also for each cycle, the storage switch is closed for a second time period during the first time period and, after the second time period, the storage switch is opened. The time between the opening of the storage switch in a given cycle and the closing of the storage switch in a subsequent cycle is a memory time that is controlled in response to the first time period.

According to another example embodiment, a reference voltage is generated from a power supply voltage that fluctuates over a range of voltages. An internal voltage is generated from the power supply voltage, the internal voltage corresponding to a low voltage in the range of voltages, and a reference voltage is generated from the internal voltage. The reference voltage is stored at a storage circuit, and the stored voltage is provided as an output. The power supply is cyclically coupled for generating the reference voltage, and the storage circuit is cyclically coupled for storing the reference voltage. The cyclic coupling is controlled as a function of circuit characteristics of the storage circuit and a circuit connecting the reference voltage to the storage circuit.

The above summary of the present invention is not intended to describe each embodiment or every implementation of the present invention. Other aspects of the invention will become apparent and appreciated by referring to the following detailed description and claims taken in conjunction with the accompanying drawings.

The invention may be more completely understood in consideration of the following detailed description of various embodiments of the invention in connection with the accompanying drawings, in which.

Figure 1:
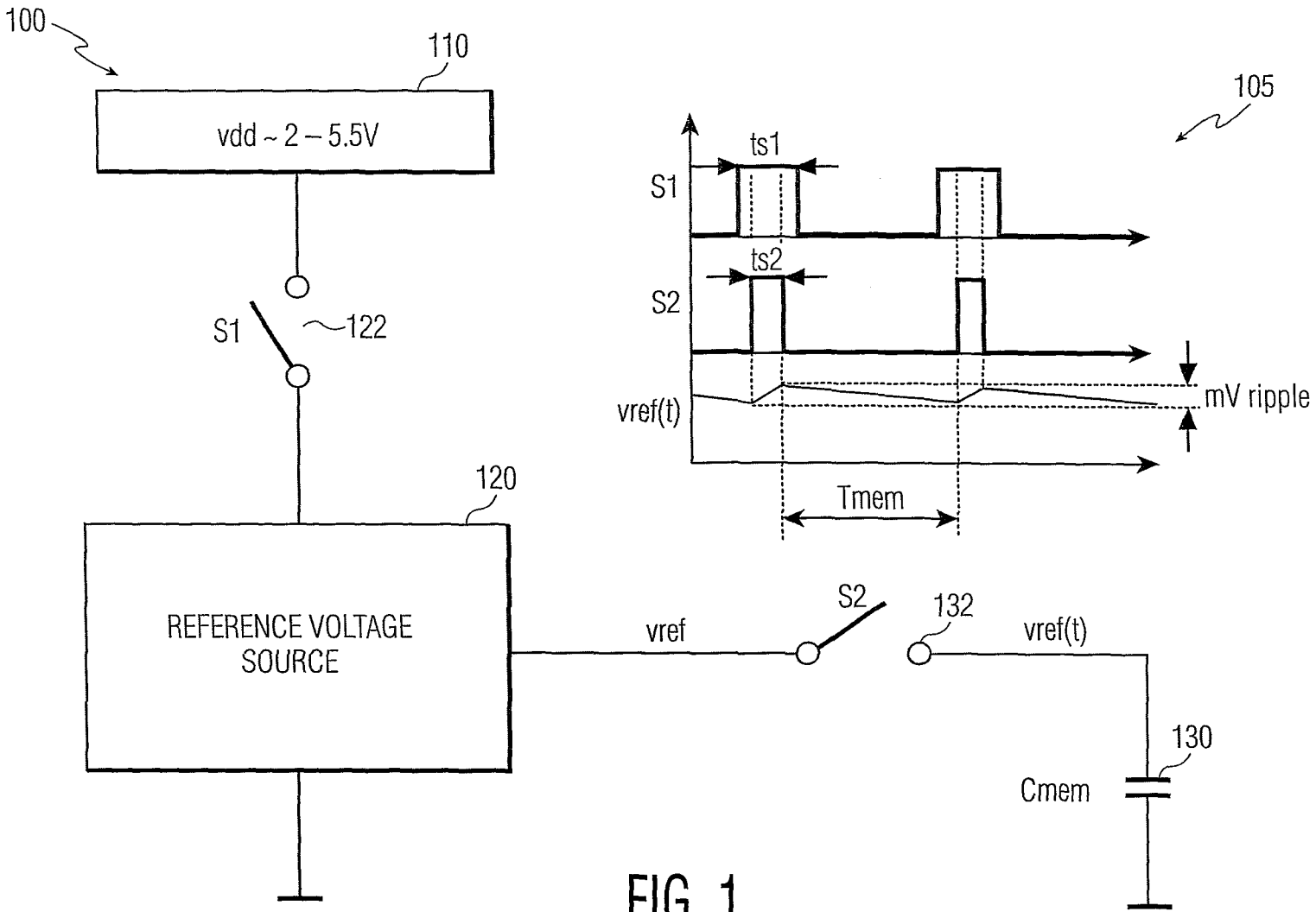
FIG. 1 shows a reference voltage circuit and approach employing a sample & hold approach, according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the invention as defined by the appended claims.

The present invention is believed to be applicable to a variety of arrangements and approaches for supplying low power. While the present invention is not necessarily limited to such applications, an appreciation of various aspects of the invention is best gained through a discussion of examples in such an environment.

According to an example embodiment of the present invention, a power control circuit provides a low-power, consistent reference voltage from a fluctuating power source. A supply regulator generates an internal voltage supply from a fluctuating power supply, and the internal voltage supply is stored on a cyclic-type basis. The timing of storage and subsequent refresh events are specifically controlled, relative to the characteristics of the power control circuit, to make the generation of a consistent, low power reference voltage possible for a multitude of applications.

According to another example embodiment of the present invention, a reference voltage control circuit couples a power supply in a manner that mitigates undesirable power consumption and/or loss conditions, including those relating to fluctuations in power supply voltage (Vdd). A regulation loop generates a constant internal supply voltage on Vdd to provide a reference voltage (Vref) that is generally free from fluctuations exhibited by the supply voltage Vdd. The supply voltage Vdd is thus used as the voltage supply to the regulation loop, which uses Vdd and to provide Vref as a generally flat or fluctuation-free voltage supply (e.g., relative to fluctuations in Vdd).

A sample-and-hold approach is used to reduce current consumption as follows. The reference voltage Vref is stored at a storage device (e.g., on a capacitor), with the value of Vref dropping between storage cycles according to leakage current (e.g., to ground via the circuit connecting the storage device for providing the voltage). This approach, without more, can exhibit a ripple effect of some mVolts.

A compensation circuit controls the aforesaid leakage effect (ripple effect) by controlling the time during which power is supplied and stored, relative to the components of the circuit. A power switch is controlled to couple the power supply to a storage switch that is controlled to couple power to a storage device. Each switch respectively closes for a set time during each cycle, with the power switch closed to couple the power supply to the storage switch while the storage switch is closed. The time between the closing of the storage switch for a particular cycle, and the opening of the storage switch for a subsequent cycle is set at a time ratio of at least about 2:1, relative to the time that the power switch is closed during each cycle. In this context, for each cycle, the power switch opens just before the storage switch opens and closes just after the storage switch closes.

Turning now to the figures, FIG. 1 shows an exemplary circuit 100 and time plot 105 for an embodiment involving the control of the application of the relative power and storage switches with a sample & hold-type approach as follows. A power supply 110 supplies a voltage "vdd" and is coupled to a reference voltage source 120 by a power supply switch S1 (122). The reference voltage source 120 provides a reference voltage "vref" and is coupled to a storage circuit 130 by a storage switch S2 (132).

The power supply switch 122 (S1) and storage switch 132 (S2) respectively close for times "ts1" and "ts2" as shown in the plot 105, with the level of each switch and the reference voltage vref plotted over time. The time between the closing of the storage switch in a particular cycle and the opening of the storage switch in an immediately subsequent cycle is characterized as "Tmem" (the time during which the voltage level is held or "stored" in the storage device). The ratio of Tmem:ts 1 is controlled to be greater than about 2:1 by controlling the switch operation and selection of operating characteristics and circuit components such as switch size and characteristics of the storage device 130 (e.g., size of a capacitor). This control mitigates significant "ripple" or fluctuation in vref over time as represented by "mV ripple," which may be nearly or about zero for various applications.

Figure 2:
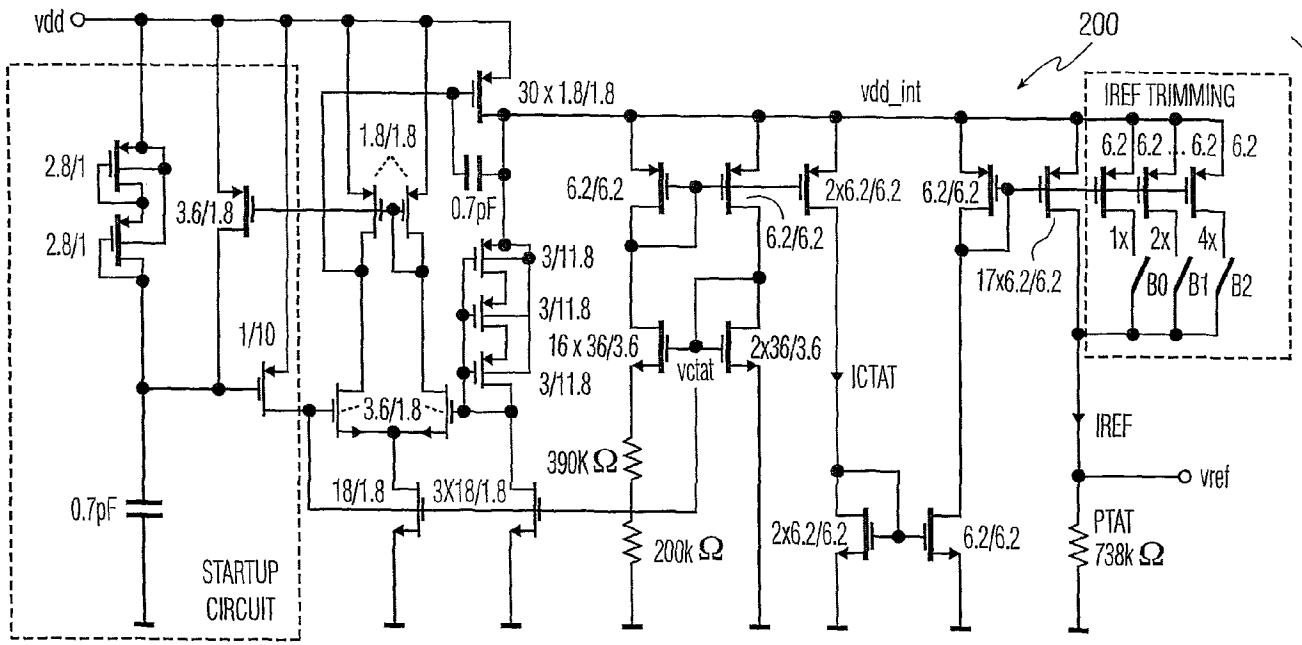
FIG. 2 shows a low voltage power source control circuit, according to example embodiments of the present invention.

FIG. 2 shows a system 200 for providing a reference voltage (vref) using a power supply (vdd), according to another example embodiment of the present invention. Generally, the system 200 uses a regulation amplifier to hold an internal power supply (vdd_int) of the reference voltage generally constant. The regulation amplifier is implemented with a sample & hold technique (e.g., as described above), to facilitate low current consumption in providing relatively constant, temperature-independent vref. For instance, where vdd fluctuates from 2V to 5.5V, such a regulation amplifier as implemented with a current consumption of about 300 nA and a sample & hold approach as described above generates vref at a very low current consumption (e.g., about 800 nA for a 5.5V power supply vdd).

The regulation loop that generates vdd_int includes a two stage amplifier. The first stage is a single ended differential amplifier with NMOS transistors shown as W/L=3.6/1.8, and PMOS load transistors shown as W/L=1.8/1.8. An NMOS current source for the differential amplifier with W/L=18/1.8 delivers a low current of about 75 nA. The second stage includes a low ohmic PMOS transistor with 30×1.8/1.8 matching to the PMOS load elements of the single ended differential amplifier and the NMOS load element, which includes the NMOS current source with W/L=3×18/1.8. The current consumption of the second stage is about 225 nA.

Figure 3:
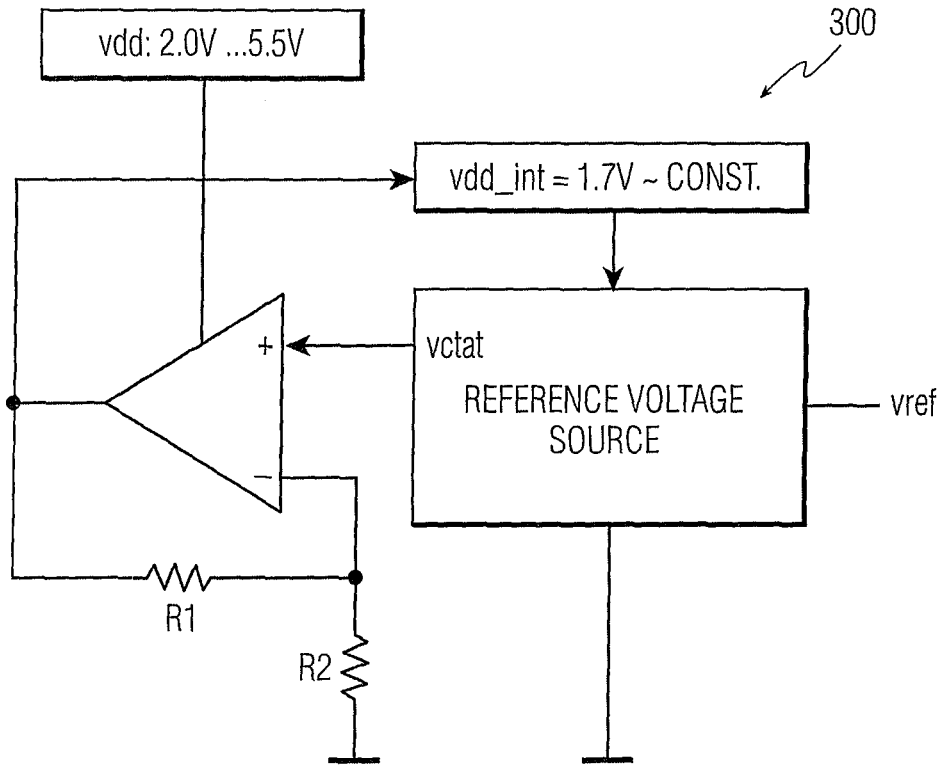
FIG. 3 shows a regulated supply voltage, according to another example embodiment of the present invention.

The system 200 in FIG. 2 implements functional characteristics shown in circuit 300 of FIG. 3 (and as implemented in connection with FIG. 1) in connection with various embodiments. The resistors R1 and R2 in the feedback loop of FIG. 3 are implemented respectively by three stacked PMOS transistors shown with W/L=3/11.8 (for R1) and the NMOS current source with 3×W/L=18/1.8 (for R2). The adjustment of vdd_int=2V is carried out by the dimensioning of the relation R1/R2. In many applications, the stacked PMOS transistors of R1 are the primary devices for controlling this relation, and the NMOS current source generally determines the time constant of the regulation of vdd_int.

In some applications, the current consumption (about 300 nA) of the regulation loop amplifier sets the time constant of the regulation to be relatively large, and therefore is characteristic of DC regulation (e.g., relative to high speed regulation). From the AC behavior, the closed loop gain of the amplifier is about 17 dB and the phase margin is about 65 degrees.

Example operational characteristics of the system 200 in FIG. 2 are shown in table form, for DC power supply rejection ratio (PSRR(DC)) values over an example vdd power range of 2V to 5.5V. These PSRR(DC) values range from 77 dB to 95 dB.

For these approaches, the low vdd value generally relates to process parameters involving the threshold voltages of the NMOS and PMOS transistors. For example, for a given 1 um-CMOS process in FIG. 2, the lowest value of vdd is generally about 2V because at a temperature (T) of about −40° C., the behavior of vctat (complementary-to-absolute-temperature voltage) generates a vdd_int value of about 1.95V. With this approach, the low temperature determines a low (e.g., minimum) value of vdd. If at that point, vdd=2V and vdd_int=1.95V, then the VDS value of the PMOS gain transistor is 50 mV, generally corresponding to a DC regulation for vref of around 95 dB. The W/L value of the PMOS gain transistor is set relatively large (30×1.8/1.8) to set an IDS current through this transistor, as applicable to vdd values that could be slightly below 2V. At room temperature, the value of vdd_int is about 1.7V. If a corresponding minimum value of vdd is 1.7V and vdd_int should be also regulated to 1.7V, then the VDS value of the PMOS gain transistor is about 0. Therefore, the minimum value of vdd can be set to about 1.75V to generate a high PSRR(DC) value.

In addition to the above, current mirrors in the reference source has an influence to the value of vdd_int respective to the minimum value of vdd as well. For instance, if the design exhibits minimum dimensions of W and L (for instance W/L=1/1), then the changing of vdd_int can be in the order of 100 mV and the minimum value of vdd can be considered in the same order of changing. Referring to FIG. 2, current mirrors can accordingly be implemented with generally larger W/L values of about 6.2/6.2 to reduce this influence. This results in a robust design and facilitates a high yield with high PSRR(DC) values of the reference voltage source, over a wide power range of vdd from 2V until 5.5V.

If all load elements of the gain stages of the regulation amplifier are cascaded, PSRR(DC) values are greater than about 90 dB. In these contexts, various embodiments are directed to operating at a compromise between high PSRR (DC) values and a large power range of vdd.

The reduction or other control of a minimum value of vdd to values of 1.8V or less is technology dependent, and controlled differently for a variety of implementations. For the applications such as that shown in FIG. 2, the reduction to vdd_int=1.75V at a temperature T=−40° C. to facilitate a minimum value of vdd=1.8V is possible, but this would result in a reference voltage value of vref=1.15V at a temperature T=90° C. In this regard, the vdd value can be set to accommodate desirable performance at higher temperatures. For instance, a minimum vdd value of about 2V can be used to set values of vref which are not below 1.2V at high temperatures. In this regard, the above-discussed embodiments as implemented with FIG. 2 and otherwise are selectively used with different voltage levels for vdd, depending upon the application and temperature-dependence characteristics relating to the same. Therefore, various modifications are made in connection with FIG. 2 and otherwise, in connection with different embodiments, to facilitate similar characteristics as desirable in different applications.

Figure 4:
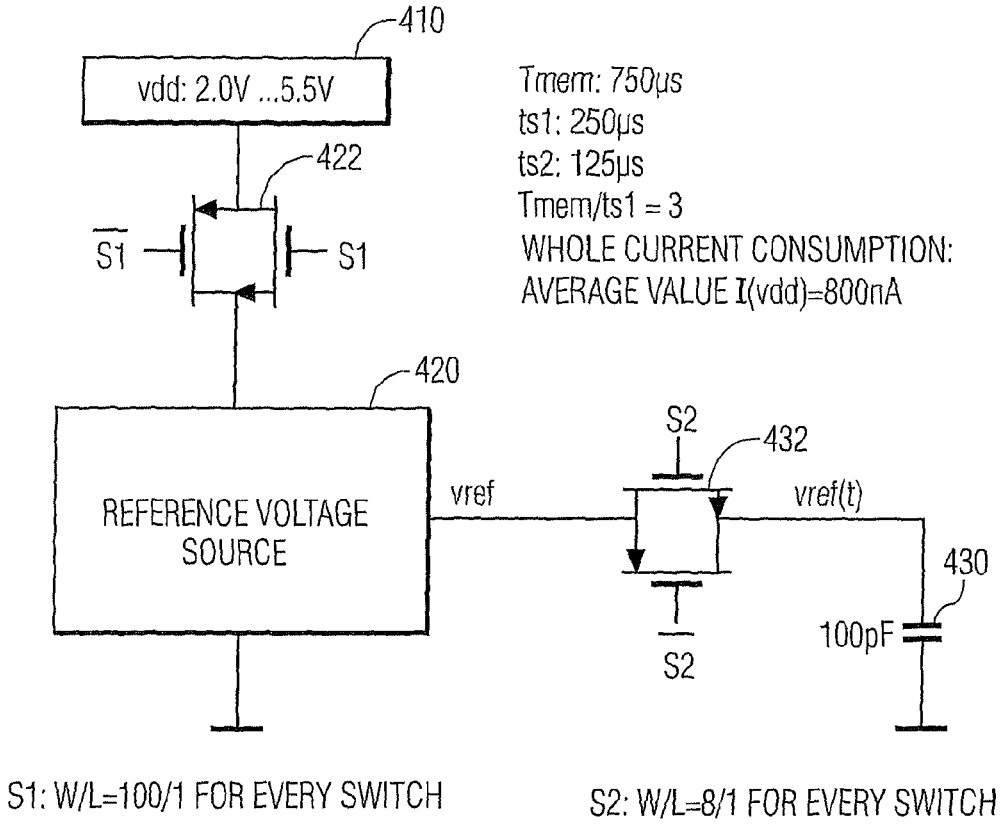
FIG. 4 shows a low voltage power source circuit, according to another example embodiment of the present invention.

FIG. 4 shows a sample & hold reference approach similar to that shown in FIG. 1, as implemented with the system 200 in FIG. 2 (and relevant to FIG. 3), according to another example embodiment of the present invention. A voltage source 410 supplies voltage vdd to a reference voltage source circuit 420 (implemented with the system 200 in FIG. 2), via switch circuit 422. The reference voltage source circuit 420 provides a reference vref to a storage device 430, via switch circuit 432.

Referring back to FIG. 1, and in connection with an example embodiment, Tmem, Ts1 and Ts2 as shown in FIG. 4 are respectively set to 750, 250 and 125 microseconds, such that Tmem/ts1 is 3. The current consumption in maximum for vdd=5.5V has an average value of about I(vdd)=0.8 μA. The ripple of vref on the storage device 430 (relevant, for instance, to the ripple shown in FIG. 1) is on the order of about 5 mV at 90° C., as implemented with a 100 pF storage capacitor and a switch W/L(S2)=8/1.

Various embodiments are directed to the application of circuits and control approaches as described herein, with a variety of devices. For example, some embodiments are directed to integrated circuits, CMOS devices, voltage detectors, analog-to-digital (A/D) converters, and other systems where a reference voltage is used as a comparison point for analog signal processing.

The various embodiments described above and shown in the figures are provided by way of illustration only and should not be construed to limit the invention. Based on the above discussion and illustrations, those skilled in the art will readily recognize that various modifications and changes may be made to the present invention without strictly following the exemplary embodiments and applications illustrated and described herein. Such modifications and changes do not depart from the true scope of the present invention that is set forth in the following claims.

What is claimed is:

1. A system for providing a low power reference voltage from a power supply that provides a power supply voltage that fluctuates over a range of voltages, the system comprising:

a regulation circuit configured to generate an internal voltage from the power supply voltage, the internal voltage corresponding to a substantially constant voltage that is lower than the range of voltages;

a reference voltage circuit coupled to the regulation circuit to receive the generated internal voltage and configured to generate a reference voltage from the internal voltage;

a sample-and-hold storage circuit coupled to the reference voltage circuit that is configured to receive the generated reference voltage, store the reference voltage, and provide the stored voltage as an output; and a control circuit configured to cyclically couple the power supply for generating the reference voltage, and cyclically couple the sample-and-hold storage circuit for storing the reference voltage, as a function of circuit characteristics of the storage circuit and a circuit connecting the reference voltage to the sample-and-hold storage circuit.

2. The system of claim 1, wherein the control circuit is configured to cyclically couple the power supply for generating the reference voltage, and cyclically couple the sample-and-hold storage circuit for storing the reference voltage, as a function of storage characteristics of the sample-and-hold storage circuit and a circuit connecting the reference voltage to the sample-and-hold storage circuit, by cyclically controlling a power supply switch to couple the power supply to the regulation circuit for a first time period, cyclically controlling a memory switch to couple the reference voltage to the sample-and-hold storage circuit for a second time period, at least a portion of the second time period being concurrent with at least a portion of the first time period, and wherein cyclically controlling the memory switch comprises controlling a time between opening of the memory switch in a given cycle, and closing of the memory switch in a subsequent cycle, as a function of storage characteristics of the sample-and-hold storage circuit and a circuit connecting the reference voltage to the sample-and-hold storage circuit.

3. The system of claim 1, wherein the control circuit is configured to cyclically couple the power supply for generating the reference voltage, and cyclically couple the sample-and-hold storage circuit for storing the reference voltage, as a function of storage characteristics of the sample-and-hold storage circuit and a circuit connecting the reference voltage to the sample-and-hold storage circuit, by cyclically controlling a power supply switch to couple the power supply to the regulation circuit for a first time period, cyclically controlling a memory switch to couple the reference voltage to the sample-and-hold storage circuit for a second time period, at least a portion of the second time period being concurrent with at least a portion of the first time period, and wherein cyclically controlling the memory switch comprises controlling the time between the opening of the memory switch in a given cycle, and the closing of the memory switch in a subsequent cycle, such that a ratio of elapsed time between the opening and closing of the memory switch, relative to the time that the power supply switch is closed for the given cycle, is at least about 2:1.

4. The system of claim 1, wherein the control circuit is configured to cyclically couple the power supply for generating the reference voltage, and cyclically couple the sample-and-hold storage circuit for storing the reference voltage, as a function of storage characteristics of the sample-and-hold storage circuit and a circuit connecting the reference voltage to the sample-and-hold storage circuit, by cyclically controlling a power supply switch to couple the power supply to the regulation circuit for a first time period, cyclically controlling a memory switch to couple the reference voltage to the sample-and-hold storage circuit for a second time period, at least a portion of the second time period being concurrent with at least a portion of the first time period, and wherein cyclically controlling the memory switch comprises controlling the time between the opening of the memory switch in a given cycle, and the closing of the memory switch in a subsequent cycle as a function of the time during which the power supply switch is closed, the time during which the memory switch is closed, operational characteristics including leakage characteristics of the memory switch, operational characteristics including storage characteristics of the sample-and-hold storage circuit, and a ratio of the elapsed time between the opening and closing of the memory switch, relative to the time that the power supply switch is closed for the given cycle.

5. The system of claim 4, wherein cyclically controlling the memory switch comprises controlling the time between opening of the memory switch in a given cycle, and closing of the memory switch in a subsequent cycle by holding the memory switch open between cycles for a time period that is about twice as long as a time period during which the power supply is coupled for generating the reference voltage.

6. The system of claim 1, wherein the control circuit is configured to cyclically couple the power supply for generating the reference voltage, and cyclically couple the sample-and-hold storage circuit for storing the reference voltage by coupling the power supply during each cycle for a time period that is less than about one half a time period during which the sample-and-hold storage circuit is not coupled between subsequent cycles.

7. The system of claim 1, wherein the regulation circuit is a regulation amplifier.

8. The system of claim 1, wherein the regulation circuit is a two-stage regulation amplifier, the first stage comprising a single-ended differential amplifier and the second stage comprising a PMOS transistor.

9. The system of claim 1, wherein the regulation circuit comprises:

a temperature-proportional circuit to generate an internal voltage that is substantially consistent over a range of operating temperatures.

10. A storage and control circuit arrangement for providing a reference voltage from a power supply that provides a power supply voltage that fluctuates over a range of voltages, the storage and control circuit arrangement comprising:

a power supply switch configured to connect the power supply for generating the reference voltage from an internal voltage, the internal voltage corresponding to a substantially constant voltage that is lower than the range of voltages;

a storage circuit configured to receive and store the generated reference voltage;

a storage switch configured to couple the storage circuit to the generated reference voltage; and a control circuit configured to control closing and opening of the power supply switch and the storage switch to cyclically couple the power supply and the storage circuit as a function of circuit characteristics of both the storage circuit and the storage switch by, for each cycle closing the power supply switch for a first time period and, after the first time period, opening the power supply switch, and closing the storage switch for a second time period during the first time period and, after the second time period, opening the storage switch, wherein a time between opening of the storage switch in a given cycle and closing of the storage switch in a subsequent cycle is a memory time that is controlled in response to the first time period.

11. The storage and control circuit arrangement of claim 10, wherein the ratio of the memory time to the first time period is at least about 2:1.

12. The storage and control circuit arrangement of claim 10, wherein the ratio of the memory time to the first time period is set as a function of leakage characteristics and storage characteristics of the storage circuit.

13. The storage and control circuit arrangement of claim 10, wherein the storage circuit comprises a capacitor, and the control circuit is configured to control closing and opening of the power supply switch and the storage switch to cyclically couple the power supply and the storage circuit as a function of the first time period, the second time period, the memory time, the size of the capacitor, and leakage characteristics of the storage switch.

14. The storage and control circuit arrangement of claim 10, further comprising:

a temperature-proportional regulation circuit that is selectively coupled to the power supply via the power supply switch and configured to generate an internal temperature-compensated voltage from the power supply; and a reference voltage circuit that is selectively coupled to the storage circuit by the storage switch and configured to generate the reference voltage using the temperature-compensated voltage.

15. A method for providing a reference voltage from a power supply that provides a power supply voltage that fluctuates over a range of voltages, the method comprising:

generating an internal voltage from the power supply voltage, the internal voltage corresponding to a substantially constant voltage that is lower than the range of voltages;

generating a reference voltage from the internal voltage;

storing the reference voltage at a storage circuit;

providing the stored voltage as an output; and cyclically coupling the power supply for generating the reference voltage; and cyclically coupling the storage circuit for storing the reference voltage as a function of circuit characteristics of the storage circuit and a circuit connecting the reference voltage to the storage circuit.

16. The method of claim 15, wherein cyclically coupling the storage circuit for storing the reference voltage comprises, for each cycle:

closing the storage circuit while the power supply is coupled for generating the reference voltage; and subsequently opening the storage circuit, wherein time between the opening of the storage circuit in a given cycle and the closing of the storage circuit in a subsequent cycle is a memory time that is set as a function of the time that the power supply is coupled in the given cycle.

17. The method of claim 16, wherein a ratio of the memory time to the time that the power supply is coupled in the given cycle is at least about 2:1.

18. The method of claim 15, wherein cyclically coupling the power supply comprises, for each cycle:

closing a power supply switch to couple the power supply; and subsequently opening the power supply switch to de-couple the power supply; and cyclically coupling the storage circuit comprises, for each cycle:

closing a storage switch to couple the storage circuit; and subsequently opening the storage switch to de-couple the storage circuit; and setting a ratio of the memory time to the time that the power supply switch is closed for the given cycle as a function of leakage characteristics and storage characteristics of the storage circuit.

19. The method of claim 15, wherein generating an internal voltage further comprises:

using a temperature-proportional regulation circuit to generate an internal temperature-compensated voltage from the power supply voltage; and generating a reference voltage comprises using the temperature-compensated voltage to generate the reference voltage.

20. The method of claim 15, wherein the storage circuit is a capacitor, and cyclically coupling the storage circuit comprises, for each cycle:

closing a storage switch to couple the reference voltage to the capacitor for a storage time period; and cyclically coupling the power supply for generating the reference voltage, and cyclically coupling the storage circuit for storing the reference voltage, as a function of circuit characteristics of the storage circuit and a circuit connecting the reference voltage to the storage circuit, comprises:

cyclically coupling the power supply; and cyclically coupling the capacitor as a function of a size of the capacitor and leakage characteristics of the storage switch.

* * * * *